United States Patent [19]

Narozny

[11] 4,415,216

[45] Nov. 15, 1983

[54] CONNECTOR FOR MASS-GROUND TERMINATION OF MULTICONDUCTOR CABLE

[75] Inventor: Ronald S. Narozny, Panorama City, Calif.

[73] Assignee: Thomas & Betts Corporation, Raritan, N.J.

[21] Appl. No.: 240,026

[22] Filed: Mar. 3, 1981

[51] Int. Cl.[3] ..... H01R 4/66; H01R 13/58

[52] U.S. Cl. ..... 339/107; 339/14 R; 339/17 F; 339/176 MF

[58] Field of Search ..... 339/14 R, 17 F, 176 MF, 339/97 P, 107

[56] References Cited

U.S. PATENT DOCUMENTS

| | | | |
|---|---|---|---|
| 3,713,073 | 1/1973 | Narozny | 339/17 |
| 3,731,251 | 5/1973 | Sinclair | 339/17 |
| 3,879,099 | 4/1975 | Shaffer | 339/107 X |
| 4,005,921 | 2/1977 | Hadden et al. | 339/14 R |
| 4,027,941 | 6/1977 | Narozny | 339/14 |
| 4,083,615 | 4/1978 | Volinskie | 339/17 |
| 4,084,878 | 4/1978 | Wahi | 339/99 |
| 4,169,640 | 10/1979 | Lee | 339/14 P |
| 4,195,893 | 4/1980 | Stupay | 339/14 R |

*Primary Examiner*—Eugene F. Desmond

*Attorney, Agent, or Firm*—Robert M. Rodrick; Salvatore J. Abbruzzese; Jesse Woldman

[57] ABSTRACT

A connector receives a multiconductor cable with one channel receiving ground conductors of the cable in disposition running lengthwise with the cable and another channel receiving signal conductors of the cable bent sidewise to the cable length. Individual contacts engage the cable signal conductors and a common electrical interface is obtained with the ground conductors. At least one of the individual contacts is interconnected with the common interface and all of the contacts are accessible exteriorly of the connector housing, whereby each signal conductor and the common ground are conveyed to accessory apparatus through the cable-terminating connector.

20 Claims, 6 Drawing Figures

CONNECTOR FOR MASS-GROUND TERMINATION OF MULTICONDUCTOR CABLE

FIELD OF THE INVENTION

This invention relates generally to electrical connectors and pertains more particularly to connectors for terminating transmission cables in manner providing for selective grounding of plural cable conductors.

BACKGROUND OF THE INVENTION

In certain signal transmission applications employing flat multiconductor cables, signal shielding requirements demand that each signal conductor be disposed between a pair of ground conductors dedicated solely to that signal conductor. The succession of conductor assignments laterally of the elongate cable is thus G (ground), S (signal), G, G, S, G, G, S, G, etc. While it is preferable to mass-terminate such cable, by insulation-piercing techniques such as are shown in Applicant's copending, commonly-assigned patent application, Ser. No. 143,003, filed on Apr. 23, 1980, entitled "Ground Terminating Connector for Flat Cable", and also in commonly-assigned U.S. Pat. No. 4,027,941 to Narozny, these techniques are not applicable where conductor spacing is so close as to afford less than adequate room for insulation-piercing. Considering a practical instance, the spacing between laterally successive signal conductors in the GSGGSG system may be 0.05 inch. However, the spacing between each such signal conductor and each of its dedicated ground conductors, center line-to-center line, may be as little as 0.010 inch. With conductors themselves being of 0.007-inch diameter, the matter of providing enough strength in an insulation-piercing contact in such limited space environment renders mass termination difficult at the very least.

Various prior art efforts have addressed the matter of mass-ground-terminating flat multiconductor cable by preparing the cable to have bared conductor ends which are then inserted into connectors and placed in engagement with contacts for termination. Such efforts, set forth in the statement filed herein pursuant to 37 CFR 1.97 and 1.98, are limited in that they do not provide selectivity of placement of output ground connector contacts, such as in linewise or coplanar disposition with output signal connector contacts.

SUMMARY OF THE INVENTION

The present invention has as its primary object the provision of an improved termination arrangement for flat multiconductor cable.

It is a more particular object of the invention to provide for mass-ground-termination of ground conductors of multiconductor transmission cable.

In attaining these and other objects, the invention provides a connector having a housing defining first and second channels, mutually non-aligned, for receiving first (signal) and second (ground) groups of the bared conductor ends of a flat multiconductor cable. Electrical contacts are supported by the housing in registry with the first channel for connection with the bared conductor ends of the first group. Electrically conductive means is disposed in the housing second channel in registry with the second group of conductor bared ends to provide common electrical connection thereof. Electrical interconnection is made between the conductive means and at least one of the contacts and, as the housing defines access exteriorly thereof to all contacts, the common electrical connection and signal intelligence may be carried forth to accessory apparatus.

In the preferred embodiment, adapted particularly to mass-ground-terminate cable having conductor assignment in the above-noted GSGGSG arrangement, signal conductors have their bared ends bent to permit their disposition in the first channel and the bared ends of ground conductors extend into the second channel. The conductive means in the second channel is in the form of a strip member in contiguous relation to the ground conductor bared ends. Interconnection may be made, by lips integral with the strip member, redundantly from the strip member to all contacts which are not in registry with the signal conductor bared ends. Cable strain relief is provided by opposed strain relief members which are detentably captive by the housing on its receipt of the cable.

As output ground contacts may be arranged in any desired linewise relation with signal contacts in the first channel and interconnected by lips to the strip member, any selected arrangement may be provided of signal and ground output contacts.

The foregoing and other features of the invention will be further understood from the following detailed description of the preferred embodiment of the invention and from the drawings thereof, wherein like reference numerals identify like parts throughout.

DESCRIPTION OF THE PREFERRED EMBODIMENTS

Figure 1:
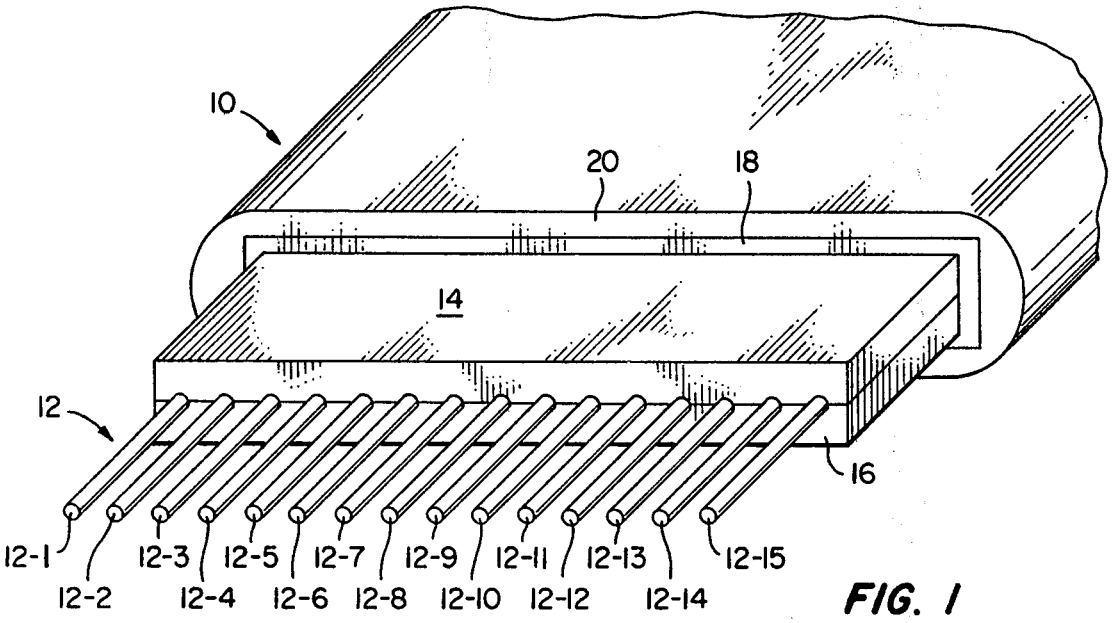
FIG. 1 is a perspective illustration of a flat multiconductor transmission cable prepared for termination in accordance with the invention.

Referring to FIG. 1, cable 10 is a type of flat multiconductor transmission cable in present commercial use, having an arrangement of elongate conductors 12, uniformly spaced laterally of the cable. Electrically insulative layers 14 and 16 encase the conductors and typically are laminated onto the conductors. A material of type not readily insulation-pierceable, e.g., polytetrafluoroethylene, such as that commercially available under the trademark TEFLON from E. I. Du Pont de Nemours and Company, Wilmington, Del. is generally employed for such laminating. The composite of conductors 12 and insulation 14–16 is circumscribed by a shield 18, which may be a woven metallic film. Exteriorly of shield 18, cable 10 includes a jacketing 20 of electrically insulative material adapted to provide mechanical abuse resistance, customarily polyvinyl chloride (PVC).

Cable 10 may be prepared for termination in accordance with the invention by removing jacketing 20 and shield 18 to expose an extent of insulation 14–16. Insulation 14-16 is itself stripped back a given amount to expose bared ends of conductors 12. In accordance with the dedication of conductors above discussed, conductors 12-1, 12-3, 12-4, 12-6, 12-7, 12-9, 12-10, 12-12, 12-13 and 12-15 serve as ground conductors, providing dedicated ground pairs for signal conductors 12-2, 12-5, 12-8, 12-11 and 12-14.

Figure 2:
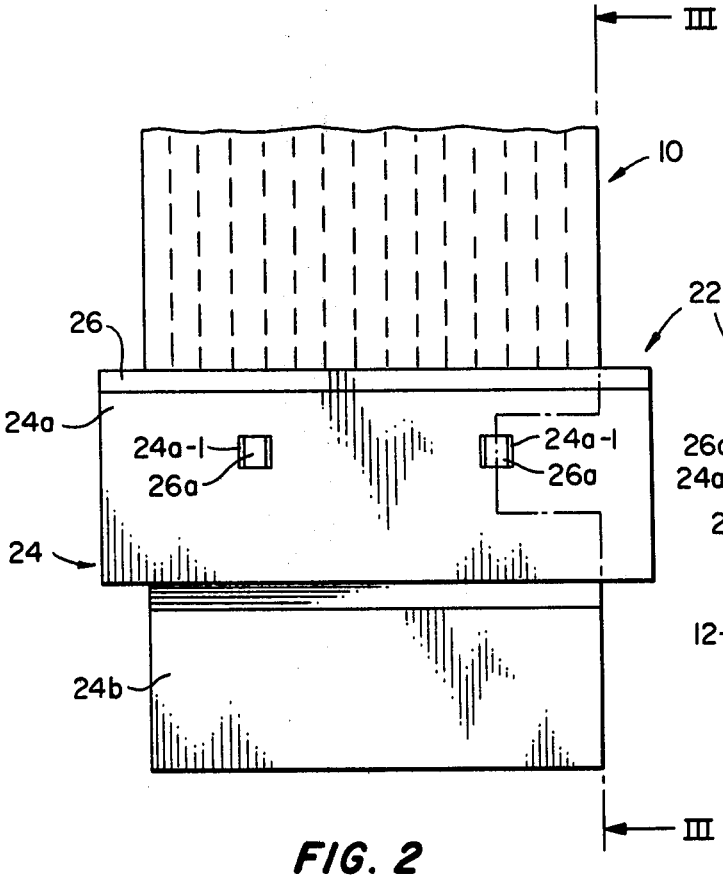
FIG. 2 is a front elevation of a connector in accordance with the invention with the FIG. 1 cable assembled therewith and terminated by the connector.
Figure 3:
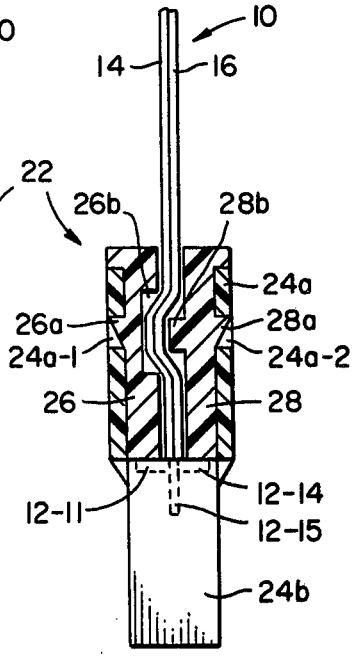
FIG. 3 is a side elevation of the FIG. 2 connector-cable arrangement as seen from viewing line III—III of FIG. 2.

Considering now FIGS. 2 and 3, connector 22 includes housing 24 having upper portion 24*a* and lower portion 24*b*, the former adapted for receipt of cable 10 and the latter adapted for interconnection with accessory apparatus. Housing portion 24*a* includes a central cavity for receiving strain-relief members 26 and 28 and has openings 24*a*-1 and 24*a*-2 on respective opposite surfaces serving as detents for capture of exterior protrusions 26*a* and 28*a* of strain relief members 26 and 28. Cable 10 is captured in turn within members 26 and 28 by being imparted into a serpentine or sinuous configuration in cable path therethrough, as is effected by complemental interior structure of the members. Thus, recess 26*b* is formed in member 26 and rib 28*b* is formed on member 28 in complemental configuration and opposed location to divert cable 10 leftwardly in FIG. 3, in its passage through housing 24. Resilient inward forces are imposed by housing upper portion 24*a* on members 26 and 28 to force same into confining engagement with cable 10. For purposes which will be discussed in connection with FIG. 5 below, insulation 14-16 has its end margin adjacent the bared conductor ends disposed in a location flush with the lower end margins (FIG. 3) of strain relief members 26 and 28, whereby the conductor bared ends are in a preselected location within housing 24 as they emerge exposed from insulation 14-16. As is shown in phantom in FIG. 3, for purposes of introducing FIGS. 5–6, the bared end of conductor 12-15 is shown extending vertically from such preselected location, conductor 12-14 has its bared end extending in horizontally bent manner rightwardly in FIG. 3 and conductor 12-11 has its bared end extending in horizontally bent manner leftwardly in FIG. 3.

Figure 5:
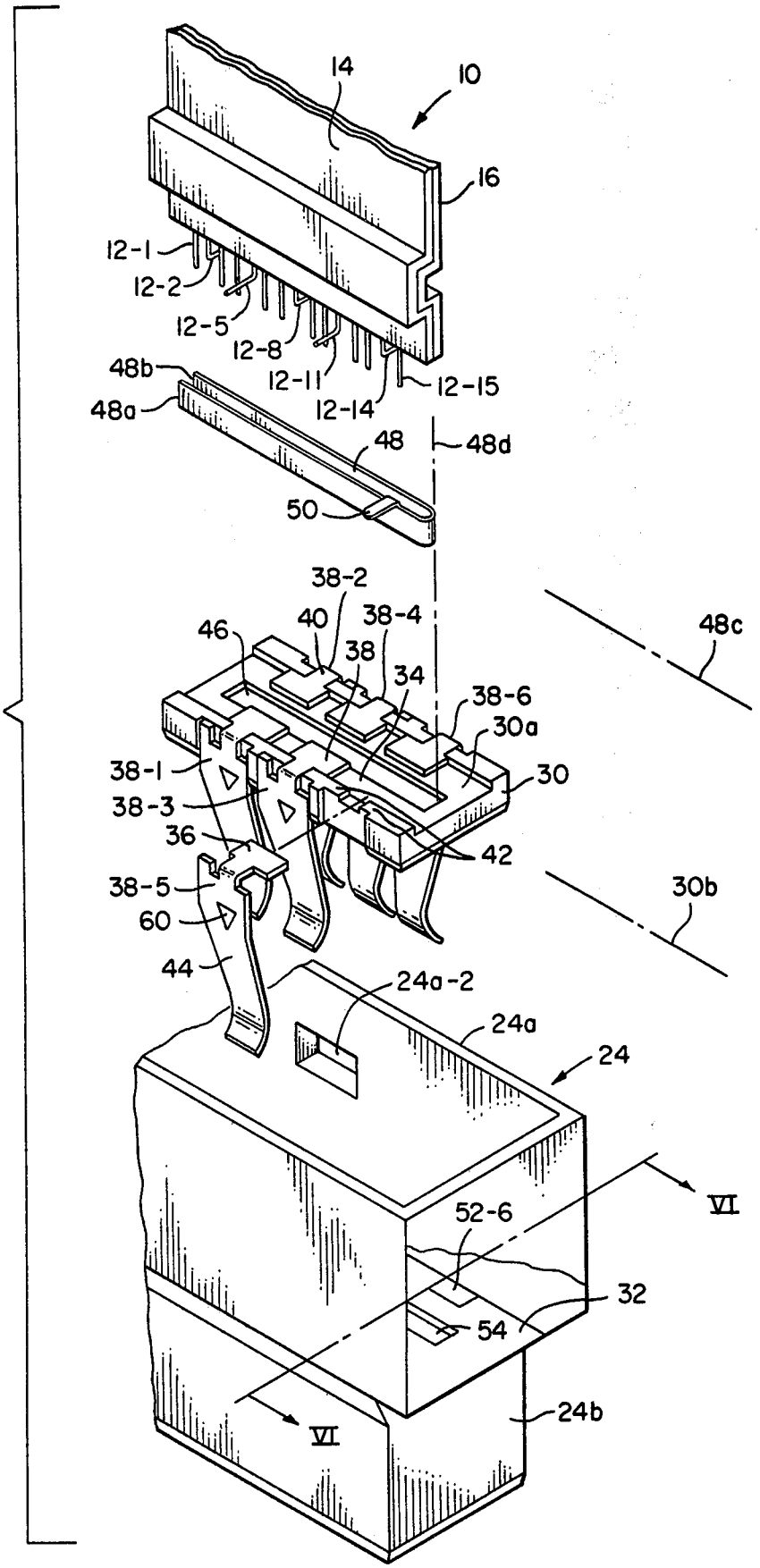
FIG. 5 is an exploded view of the component parts of the FIG. 2 connector-cable arrangement.

Referring to the exploded component parts in FIG. 5, housing insert 30 is seatable upon lower housing seat 32 and has its upper surface 30*a* configured to define lands 34 for supporting expanded base ends 36 of contacts 38. Contacts 38 include also necked-down portions 40 engaged captively by crenellations 42 of insert 30 and the contacts 38 including tails 44, shown as terminals in the form of socket blades. Centrally of opposed sets of lands 34, insert 30 defines slot 46 for receipt and support of electrically conductive means in the form of U-shaped metallic member 48. In the illustrated embodiment, an interconnect means, shown in the form of tab 50, extends outwardly from means 48, for purposes noted below. Insert seat 32 defines in its upper surface openings for receiving contacts 38, opening 52-6 receiving contact 38-6, and also provides slot 54 for receiving conductive means 48 as it extends below insert 30.

Figure 6:
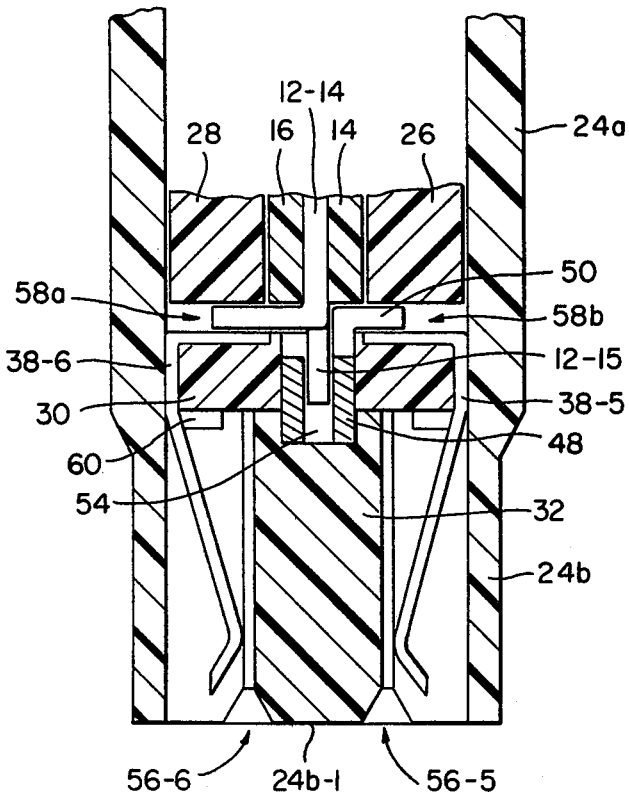
FIG. 6 is an enlarged sectional view of the assembled component parts of FIG. 5, as seen from plane VI—VI of FIG. 5.
Figure 4:
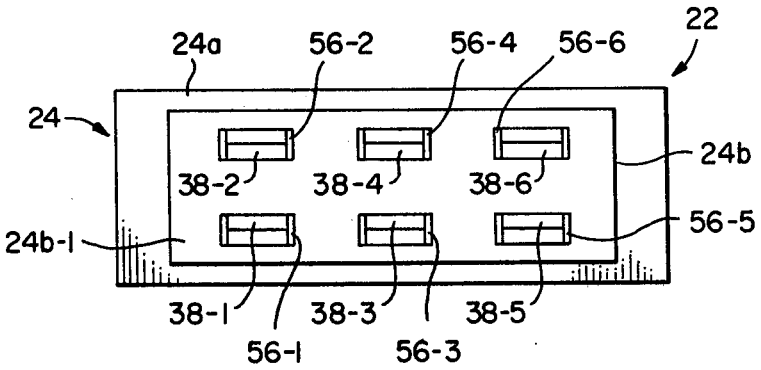
FIG. 4 is a bottom plan view of the FIG. 2 connector.

Referring now to FIG. 6, the components of the preferred embodiment of connector in accordance with the invention are shown as seen from plane VI—VI of FIG. 5 with exploded parts in full assembly. Strain relief members 26 and 28 are shown in gripping engagement respectively with insulative layers 14 and 16. Insert 30 is seated upon insert seat 32, with contacts 38-5 and 38-6 accessible through openings 56-5 and 56-6 in housing floor 24*b*-1, exteriorly of the connector, to pins (not shown) of accessory apparatus. In the illustrative embodiment, a six-contact connector is shown (FIG. 4) wherein openings 56-1 through 56-6 are provided in floor 24*b*-1, for access to contacts 38-1 through 38-6.

As is seen in FIG. 6, signal conductor 12-14 is bent leftwardly to reside in channel 58*a*, defined as between insert 30 and the lower margin of strain relief member 28, in which contacts 38, e.g., contact 38-6 as shown, are in registry for connection with the leftwardly bent conductors, e.g., conductor 12-14. A further such signal channel or first channel is identified by reference numeral 58*b* in FIG. 6. In this further signal channel would be disposed (FIG. 5) signal conductors 12-5 and 12-11. Channel 58*a* would also have in residence therein signal conductors 12-2 and 12-8. The other or second (ground) channel in housing 24 is defined by slot 46 in insert 30 and slot 54 in seat 32. As indicated, this channel contains conductive means 48 in registry therewith for connection with the ground conductors of the multiple conductor cable mass-terminated by the connector of the invention. While conductor 12-15 is shown in residence with the second channel in the FIG. 6 view, the other ground conductors, i.e., 12-1, 12-3, 12-4, 12-6, 12-7, 12-9, 12-10, 12-12 and 12-13, are also disposed therein, for connection with strip 48. In its preferred form, the strip has ends 48*a* and 48*b*, which are in longitudinal registration along axis 48*c* about which strip 48 has successive extents longitudinally running and continuous about bend axis 48*d*. Upon assembly, axis 48*c* is coincident with longitudinal axis 30*b* of insert 30, along which contacts 38 are spaced and arranged in laterally opposite groups.

In the FIG. 6 assembly of connector and cable, tab 50 is in overlying engagement with contact 38-5 and, being elected as a single tab to means 48, provides a single ground-carry-through for the connector. Thus, signals are made available through contacts 38-1 (conductor 12-5), 38-2 (conductor 12-2), 38-3 (conductor 12-11), 38-4 (conductor 12-8), and 38-6 (conductor 12-14), and the ground therefor is obtained from contact 38-5.

While the preferred embodiment has been shown by way of a fifteen-conductor GSGGSG transmission cable with five signal lines and a single ground contact being made available to accessory apparatus through the connector of the invention, the invention contemplates various other arrangements. Typically, it may be desired to replicate the entire GSGGSG cable conductor arrangement at the terminals, i.e., output contacts of the connector. In this instance, tabs 50 for each ground conductor are provided. Thus, in the cable of FIG. 1, for example, a tab 50 would be provided in overlying disposition to all of contacts 38 which are not interfaced, in channels 58*a* or 58*b*, by a cable signal conductor. For arrangements other than GSGGSG, the second channel (slots 46 and 54) will receive only those ground conductors as to which mass termination may be desired and, as noted in the described and depicted example, ground contacts may be accessed as desired.

Tabs 50 will be seen to enable any desired arrangement of output contacts, permitting a coplanar and linewise succession, e.g., GSGGSG at the output of the connector on each or either side of seat 32 at housing floor 24*b*-1.

In its shown preferred version, conductive means 48 has longitudinal extent along axis 48*c*, as by being a continuous longitudinally extending element, of measure along and desirably throughout the longitudinal succession of contact elements 38, which are spaced longitudinally along counterpart axis 30*b* of insert 30. As an alternative to the self-sustaining form of conductive means 48 as a strip of electrically conductive material, means 48 may comprise an electrical material deposited selectively in facing with bared conductor ends on the interior walls of such second channel, i.e., upon insert 30 adjacent slot 46, upon insert seat 32 adjacent slot 54, or both.

While insert 30 is shown as a member which is a separable part of housing 24, and adapted for seating upon an integral part of the housing lower portion 24*b*, i.e., seat 32, contacts 38 and conductive means 48 may be inserted into integral housing structure inclusive of the equivalent of insert 30. Also, while interconnect means 50 is shown as being integral with conductive means 48, such interconnect 50 may be provided as a separate member providing an electrical interconnection between at least one of contacts 38 and conductive strip 48.

Various changes to the indicated preferred embodiment of the invention and modifications to the component parts thereof will now be evident to those skilled in the art. For example, contacts 38 may be of other configuration and may omit capture lances 60 of FIG. 6 for retention in the connector. Also, while strain relief is shown as being applied to the insulative laminates 14 and 16, by complemental interior structure of separate and cooperative strain relief members 26 and 28, strain relief may be applied to cable jacketing 20 as desired. The particularly disclosed and described embodiment is accordingly intended in an illustrative and not in a limiting sense. The true spirit and scope of the invention are set forth in the appended claims.

What is claimed is:

1. A connector for terminating bared ends of a multiconductor cable comprising housing means for receiving said cable and supporting said bared ends in first and second mutually non-aligned channels in said housing means, a plurality of electrical contact members supported in said housing means with bases of said contact members in registry with said first channel for connection with such bared ends therein, and with tails of said contact members accessible exteriorly of said housing means, a dual-walled conductive member supported in said housing means and defining a bounded portion of said second channel for connection with such bared ends therebetween, and interconnect means for connecting said electrically conductive means to at least one of said contact members.

2. The connector claimed in claim 1 wherein said contact members are supported in spaced relation along a longitudinal axis in said housing means, said conductive means comprising an elongate member having extent along said longitudinal axis.

3. The connector claimed in claim 2 wherein said elongate member extends longitudinally throughout such spaced relation of said contact members.

4. The connector claimed in claim 3 wherein said elongate member comprises a self-sustaining strip of conductive material.

5. The connector claimed in claim 4 wherein said strip has longitudinally successive extents having respective ends in longitudinal registry.

6. The connector claimed in claim 1 wherein said interconnect means is integral with said conductive means.

7. The connector claimed in claim 6 wherein said conductive means comprises a self-sustaining strip of conductive material, said interconnect means comprising tab means extending outwardly of said strip.

8. The connector claimed in claim 7 wherein said strip has longitudinally successive extents having respective ends in longitudinal registry, said tab means comprising at least one tab longitudinally spaced from said strip ends.

9. The connector claimed in claim 1 wherein said first channel extends in mutually perpendicular direction to said second channel.

10. The connector claimed in claim 1 further including strain relief means for receiving said cable and adapted for imparting sinuous travel therethrough for said cable.

11. The connector claimed in claim 10 wherein said housing means is adapted to receive and captively retain said strain relief means therein.

12. The connector claimed in claim 11 wherein said strain relief means comprises first and second strain relief members having respective complemental structure adapted to impart such sinuous travel to said cable.

13. A connector for terminating bared ends of a multiconductor cable comprising:

a housing for receiving said cable bared ends;

an insert supported in said housing having a face thereof for accommodating said cable bared ends;

said insert and said housing defining first and second mutually non-aligned channels for receiving therein said cable bared ends;

a plurality of electrical contacts supported on said insert having a base portion in said first channel and a tail portion extending therefrom and accessible exteriorly of said housing, selected ones of said base portions being for electrical connection with selected ones of said bared cable ends extending in said first channel; and an integral conductive member within said housing adjacent said base portions, for contact with plural of said cable bared ends other than said selected ones, such plural bared ends extending within said second channel, said conductive member including at least one interconnection member extending from said conductive member into said first channel and connected to at least one of said base portions.

14. The connector of claim 13 wherein said insert further includes an opening on said face, said opening receiving said conductive member therein.

15. The connector of claim 14 wherein said opening is elongate and said base portions are disposed substantially parallel to said face of said insert and wherein said conductive member is elongate and is retained in said opening.

16. The connector of claim 15 wherein said opening extends through said face substantially perpendicularly thereto.

17. The connector of claim 15 wherein said conductive member is a dual-walled member forming a longitudinal receiving chamber therein for receipt of said cable bared ends other than such selected ones.

18. The connector of claim 17 wherein said at least one interconnection member extends from one wall of said dual-walled member.

19. The connector of claim 17 wherein said at least one interconnecting member extends perpendicular to said longitudinal chamber.

20. The connector of claim 13 wherein said insert includes crenellations captively supporting said contacts thereon.

* * * * *